US011013972B2

(12) United States Patent
Meister

(10) Patent No.: US 11,013,972 B2
(45) Date of Patent: May 25, 2021

(54) TETHERED RING AND BOTTLE GAME

(71) Applicant: Peter C Meister, Miami, FL (US)

(72) Inventor: Peter C Meister, Miami, FL (US)

( * ) Notice: Subject to any disclaimer, the term of this patent is extended or adjusted under 35 U.S.C. 154(b) by 85 days.

(21) Appl. No.: 16/528,820

(22) Filed: Aug. 1, 2019

(65) Prior Publication Data

US 2021/0031084 A1 Feb. 4, 2021

(51) Int. Cl.
*A63B 67/06* (2006.01)

(52) U.S. Cl.
CPC ..... *A63B 67/06* (2013.01); *A63B 2067/063* (2013.01)

(58) Field of Classification Search
CPC ..... A63B 67/10; A63B 7/06; A63B 2067/063; A63F 9/0208; A63F 2009/0213
USPC ..... 273/332
See application file for complete search history.

(56) References Cited

U.S. PATENT DOCUMENTS 5,171,019 A * 12/1992 Arnette ..... A63B 67/10 273/332
8,011,664 B2 * 9/2011 Hilbert, Jr. ..... A63B 67/10 273/332
9,987,538 B1 * 6/2018 Crosby ..... A63B 71/023
2004/0147345 A1 * 7/2004 Michelet ..... A63B 71/02 473/398
2008/0116644 A1 * 5/2008 Knoernschild ..... A63B 67/06 273/336
2009/0302542 A1 * 12/2009 Lendvay ..... A63B 67/10 273/336
2010/0120559 A1 * 5/2010 Biederman ..... A63B 67/06 473/470
2014/0049007 A1 * 2/2014 McGetrick ..... A63F 9/0208 273/332
2016/0339333 A1 * 11/2016 McGetrick ..... A63B 67/06

OTHER PUBLICATIONS

"Carnival Bottle Ring Toss Game"; Oriental Trading; Mar. 1, 2016: https://www.orientaltrading.com/carnival-bottle-ring-toss-game-a2-12_4571.fltr (Year: 2016).*

* cited by examiner

*Primary Examiner* — Joshua T Kennedy

(57) ABSTRACT

A tethered ring game and kit is disclosed comprising a tethered ring, means of attaching the tether to an overhead surface, and a novel bottle support apparatus configured and designed to hold and constrain an ordinary bottle in a substantially upright position. The bottle holder apparatus is fixated on a wall, post, or structure such that when a bottle is inserted and constrained, it is used in an eye-hand coordination game of chance involving a tethered ring and a bottle as the target. In practice, a ring, which is tethered and hanging from above in a position equidistant between the player and a bottle, is swung in a pendulum movement toward the bottle, which is constrained by the apparatus, in an endeavor to capture the ring over the top or neck of the bottle.

4 Claims, 4 Drawing Sheets

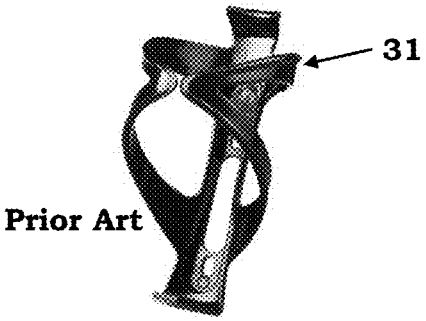
FIG 5a
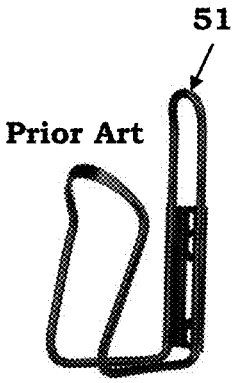
FIG 5b
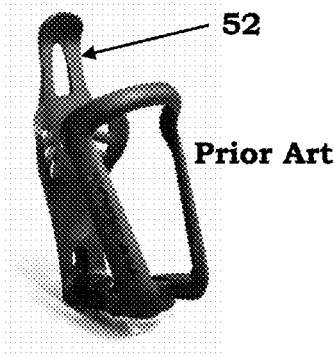
FIG 5c
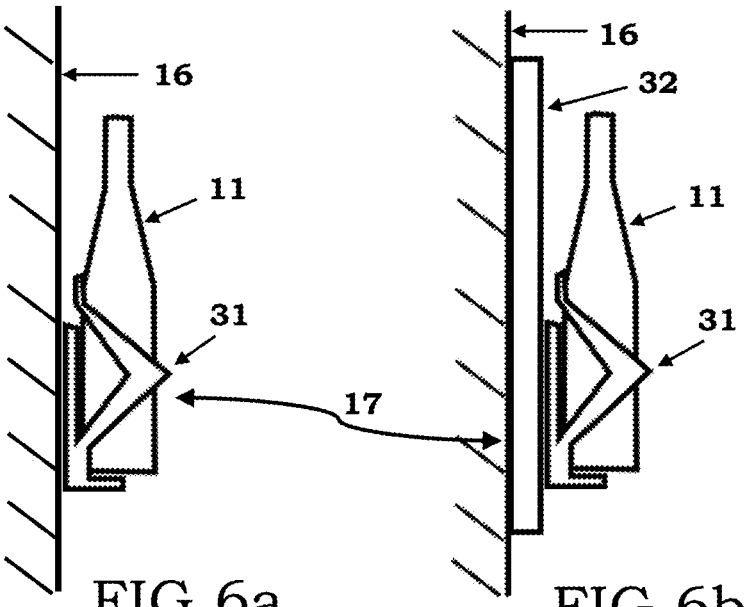
FIG 6a
FIG 6b

TETHERED RING AND BOTTLE GAME

CROSS-REFERENCE TO RELATED APPLICATIONS

There is no cross-reference to, nor are there any, related applications in this invention submittal.

STATEMENT REGARDING FEDERALLY SPONSORED RESEARCH OR DEVELOPMENT

The invention herein was made without any Federal sponsorship or contribution.

THE NAMES OF THE PARTIES TO A JOINT RESEARCH AGREEMENT

Not Applicable—There are no names or other parties to a joint research agreement involved in the invention described herein.

STATEMENT REGARDING PRIOR DISCLOSURES BY THE INVENTOR OR A JOINT INVENTOR

Not Applicable—There are no joint inventors.

BACKGROUND OF THE INVENTION

The invention described herein is a novel eye-hand coordination game of chance involving a tethered ring that is swung in a pendulum movement toward a bottle that is positioned on a vertical structure, wall or post above ground level and below the pendulum pivot point. There exist other tethered ring games where the target is a hook type element. This invention has a significant difference in that the target is a bottle, and the ring is endeavored to be captured around the bottle opening and neck.

It is well recognized in the prior art the benefit of playing games as an enjoyable method by which an individual can build their motor, eye-hand coordination, and mathematical skills. Most games have an element of chance and an element of competitive strategy that allows the player to win the game while utilizing a minimal amount of apparatus required to play the game.

In looking at the prior art in the chance element game area, specifically being concerned with ring type chance elements, in U.S. Pat. No. 5,171,019 to Arnette disclosed a tethered ring and hook game and kit. In Arnette, a brass ring is tethered to a ceiling by means of an eye screw mounted to the ceiling, further a ball-in-socket swivel is provided intermediate between the string and the eye screw to prevent the cord from being twisted as the ring is released toward the hook. A hook supported block in Arnette is adapted to be mounted to a wall by means of a dowel screw, Velcro fasteners, or a hook, and is mounted to the resilient (vibration dampening) block for receiving the ring, reference column 1, lines 66-69 and column 2, lines 6-17. Continuing in this area, looking at United States design Pat. No. U.S. D288,828 to Romestan et al. disclosed is a design for a ring toss game target board having a ring tied to a string, and a target board with eleven hooks set at different game-point values.

Yet further, in the prior art in the ring game area, in U.S. Pat. No. 4,564,200 to Loring et al. disclosed is a tethered ring game with hook configuration having a ring made of heavy material such as steel attached to a tether made of a stable and flexible material such as braided nylon cord. In Loring et al., the cord is attached to an overhead mounted pendulum base affixed to an overhead support or ceiling. The cord's length in Loring et al., is equal to the distance between the pendulum base and a wall mounted hook with the tethered ring removably engaged upon the wall mounted hook. In addition, Loring et al., modifies the standard open hook configuration by eliminating the shank and/or "goose neck" and varies the circumference of the actual circular hook portion, see in particular FIGS. 3 and 7*b*, with the goal of making the player skill required increase.

Further, in the prior art for hook and ring games that are different versions of the aforementioned hook and ring games, in U.S. Pat. No. 4,120,498 to Mutschler et al., disclosed is a self-contained hook and ring game that has a tether suspended form an overhead support wherein the ring has an extension rod or beam (or termed "second target rod 48") from the outer ring circumference with the ring swinging on the tether in an attempt to land on a plurality of hooks that are randomly mounted positionally on a vertical pole.

What is needed is a game that uses a bottle as the target of a tethered ring game. It can be the inspiration for a drinking game to be played by adults whereby a bottle of beer is placed on the bottle support while players take turns in an endeavor to capture the ring over the bottle opening and neck.

The invention described in the following is a novel tethered ring game that uses a similar ring and tether which is fixed above the target and between the player and the target. In this novel adaptation of a ring and hook game, the target is a bottle rather than a hook. The bottle is mounted above the ground on a wall or post. The player swings the ring in a pendulum motion in the direction of the bottle in an endeavor to capture the ring over the top or neck of the bottle. When the ring is successfully captured around the neck of the bottle, the player has won.

FIELD OF THE INVENTION

Game for amusement and fun.

DESCRIPTION OF RELATED ART

There is no related art associated with this novel game invention.

BRIEF SUMMARY OF THE INVENTION

The invention is a ring and bottle game apparatus that uses a novel bottle holder to position and constrain an ordinary bottle in a substantially upright position; hung on a wall, post, or structure such that when a bottle is inserted and constrained, it used in an eye-hand coordination game of chance involving a tethered ring and a bottle as the target. In practice, a ring, which is tethered and hanging from above in a position equidistant between the player and a bottle, is swung in a pendulum movement toward the bottle, which is constrained by the apparatus, in an endeavor to capture the ring over the top or neck of the bottle. Capturing the ring over the bottle indicates success and a win for the player.

BRIEF DESCRIPTION OF THE SEVERAL VIEWS OF THE DRAWINGS

FIGS. 5*a*, 5*b*, and 5*c* are examples of ordinary bottle holders of which there are many varieties that constrain a bottle in a substantially vertical position when either (a) fixated to a planer mount element or (b) directly mounted to a vertical structure, wall, or post.

FIGS. 6*a*, 6*b*, 6*c*, and 6*d* illustrate a plurality of bottle support embodiments that fixate and position a bottle above ground level such that the bottle is oriented in a substantially vertical position by mounting the various bottle holder embodiments to a vertical structure, wall, or post.

DETAILED DESCRIPTION OF THE INVENTION

Figure 1:
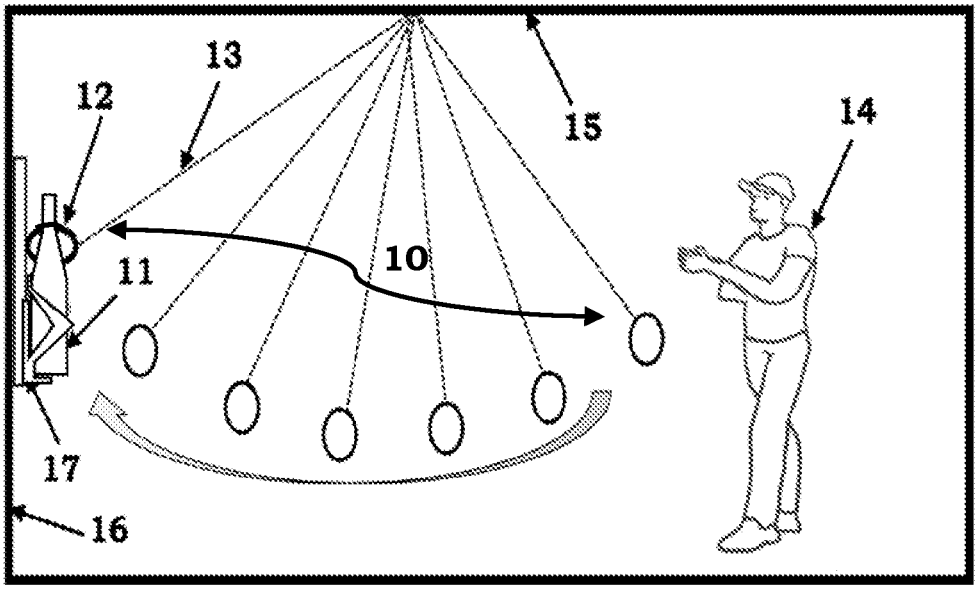
FIG. 1 is an elevation view of the tethered ring and bottle game according to an embodiment of the present invention. It illustrates the relative positions of the bottle, the ring, the tether, and the player during play. The figure further illustrates the pendulum movement of the ring that is swung by the player in the direction of the target bottle attempting to capture the ring over the bottle opening and neck.

The Inventor provides a novel apparatus used to position and constrain a bottle that is to be used as a target in a unique tethered ring and bottle game of chance and skill. A bottle holder embodiment is used to fixate and position the bottle above ground level such that the bottle is oriented in a substantially vertical position. A ring and tether embodiment is fixated to an overhead structure at a point substantially above the bottle and overhead and nearly equidistant between the player position and the bottle position. The player swings, tosses, or flips the ring in a pendulum movement and in a manner that targets the bottle opening in an endeavor to capture the ring around the bottle opening and neck. The present invention is described in enabling detail in the following examples, which may represent more than one embodiment of the present invention FIG. 1 is an elevation view of a tethered ring and bottle game 10 according to an embodiment of the present invention. It illustrates the relative positions of a bottle 11, a ring 12, a tether 13, and a player 14 during play. The figure further illustrates the pendulum movement of the ring 12 that is swung by the player 14 in the direction of the target bottle 11 attempting to capture the ring 12 over the bottle 11 opening and neck. The ring 12 and tether 13 embodiment is fixated and suspended from an overhead structure 15 that is located above the target bottle 11 and positioned between the bottle 11 and the player 14. The bottle 11 is cradled and constrained by a bottle support 17. The bottle support 17 is one embodiment of the invention and is shown fixated to a vertical structure 16, wall, or post above ground level. Various bottle support 17 embodiments and their mount options are shown later in FIGS. 6*a*, 6*b*, 6*c*, and 6*d*

Figure 2:
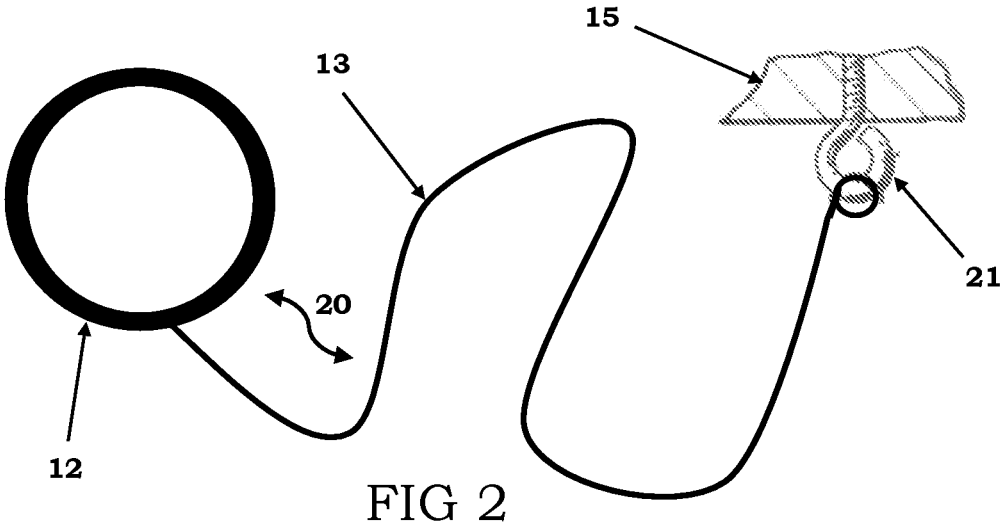
FIG. 2 is an embodiment of the ring and tether assembly element. The tether is attached to the ring by a knot, loop, crimp, or adhesive such that the ring is affixed at one end of the tether, while the other end of the tether is attached to a support structure from above.

FIG. 2 is an example of one embodiment of a ring and tether assembly 20 and is comprised of: the ring 12; the tether 13; and an eyelet 21. The ring 12 is attached to the tether 13 by a knot, loop, crimp, or adhesive such that the ring 12 is permanently affixed at one end of the tether 13, while the other end of the tether 13 is attached to the eyelet 21 that is embedded into the overhead structure 15 from above the bottle 11 mount position. The tether 13 is comprised of nylon, silk, polyester, cotton or other commercially available string or cord. The ring 12 is comprised of steel, brass, plastic, wood, or stainless steel. The eyelet 21 is comprised of steel, brass, or stainless steel.

Figure 3:
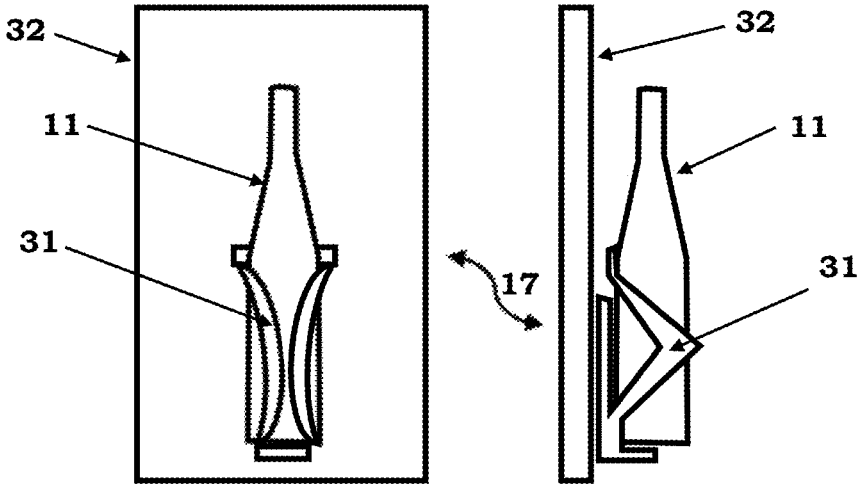
FIG. 3 is one embodiment of the invention showing a means of positioning a bottle for use as the target in the tethered ring and bottle game. This figure shows an ordinary bottle holder that is attached to a planer mount element which is in turn used to mount and position a bottle on a vertical structure for use as a target during a game.

FIG. 3 is an illustration of one embodiment of the bottle support 17 element of the invention. The bottle support 17 permits the bottle 11 to rest or be constrained in a substantially near vertical position while fixated to the vertical structure 16, wall, or post. The objective is to position the bottle 11 such that it is used as the target in the tethered ring and bottle game 10. In this example of the embodiment, an ordinary bottle holder 31 is attached to a planar mount element 32 and is fixated on the vertical structure 16, wall, or post above ground level. The commercially available bottle holder 31 is comprised of metal, plastic, wood or composite material. The planar mount element 32 is comprised of wood, metal, plastic, or composite material.

Figure 4:
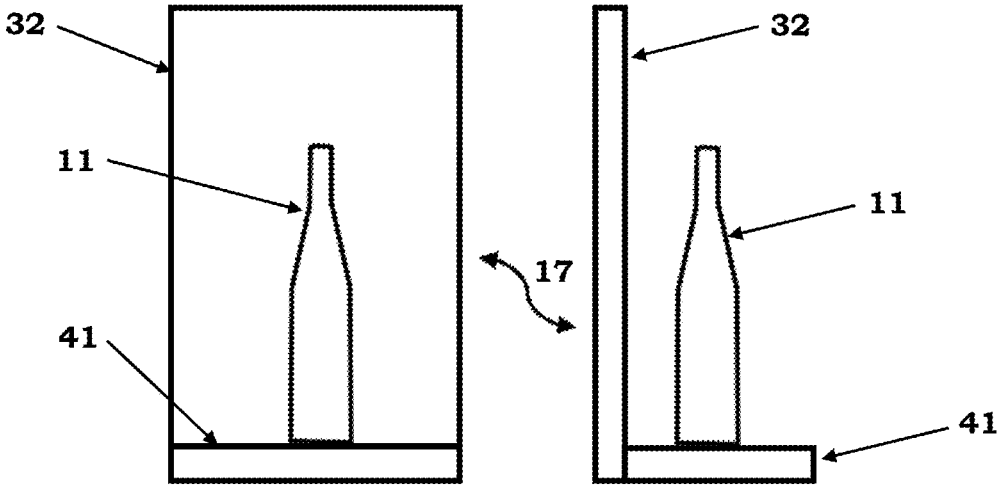
FIG. 4 is an embodiment comprised of wood, metal, plastic or composite material that forms a horizontal element structure and permits a bottle to rest or be constrained in a substantially near vertical position when either (a) fixated to a planar mount element or (b) directly mounted to a vertical structure, wall, or post.
Figures 6C, 6D:
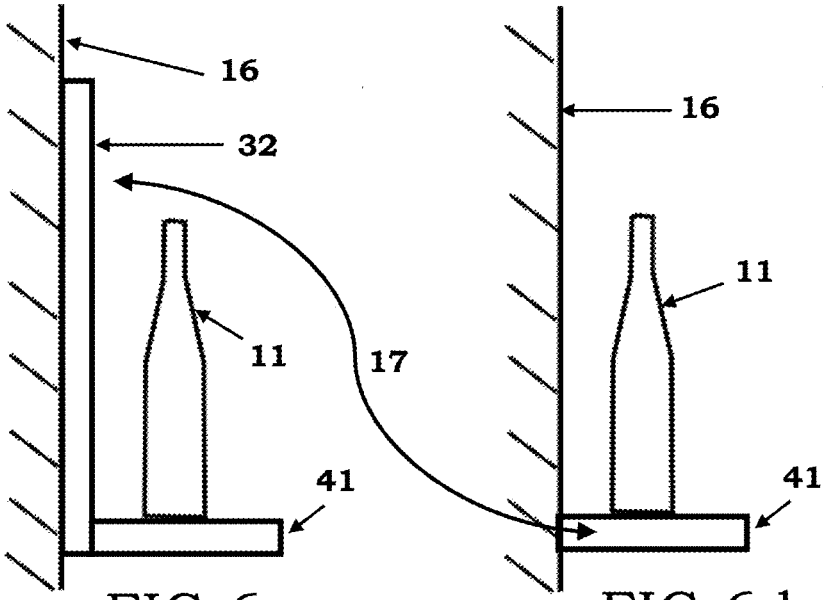

FIG. 4 illustrates yet another example of an embodiment of the bottle support 17. This figure illustrates a horizontal shelf design element of the bottle support 17 comprised of: the planar mount element 32; and a horizontal shelf element 41 that are joined at near 90 degrees to form a horizontal shelf structure for the purpose of supporting the bottle 11 in a substantially near vertical position. The horizontal shelf element 41 supports the bottle 11 and permits the bottle 11 to rest or be constrained in a substantially vertical position when either: (a) fixated to the planar mount element 32; or (b) directly fixated on the vertical structure 16, wall, or post above ground level. Refer to FIGS. 6*c* and 6*d* for clarification.

FIGS. 5*a*, 5*b*, and 5*c* are ordinary bottle holders 31, 51, and 52 of which there are many varieties that constrain the bottle 11 in a substantially vertical position when either: (a) fixated to the planar mount element 32; or (b) directly mounted to the vertical structure 16, wall, or post. Refer to FIGS. 6*a* and 6*b* for clarification.

FIGS. 6*a*, 6*b*, 6*c*, and 6*d* illustrate a plurality of bottle support 17 embodiments that fixate and position the bottle 11 above ground level such that the bottle 11 is oriented in a substantially vertical position and above ground level by mounting the various bottle support 17 embodiments to the vertical structure 16, wall, or post. FIG. 6*a* illustrates the bottle support 17 comprised of: the commercially available bottle holder 31 mounted directly to the vertical structure 16, wall or post above ground level and for the purpose to position the bottle 11 as a target in the tethered ring and bottle game 10. FIG. 6*b* illustrates the bottle support 17 assembly comprised of: the commercially available bottle holder 31; fixated to the planar mount element 32; and mounted to the vertical structure 16, wall or post above ground level and for the purpose to position the bottle 11 as a target in the tethered ring and bottle game 10. FIG. 6*c* illustrates the bottle support 17 assembly comprised of: the horizontal shelf element 41; fixated to the planar mount element 32 at near 90 degrees to form a horizontal shelf bottle support structure; and mounted to the vertical structure 16, wall or post above ground level and for the purpose to position the bottle 11 as a target in the tethered ring and bottle game 10. FIG. 6*d* illustrates the bottle support 17 comprised of: the horizontal shelf element 41 mounted directly to the vertical structure 16, wall or post above ground level and for the purpose to position the bottle 11 as a target in the tethered ring and bottle game 10.

Figure 7:
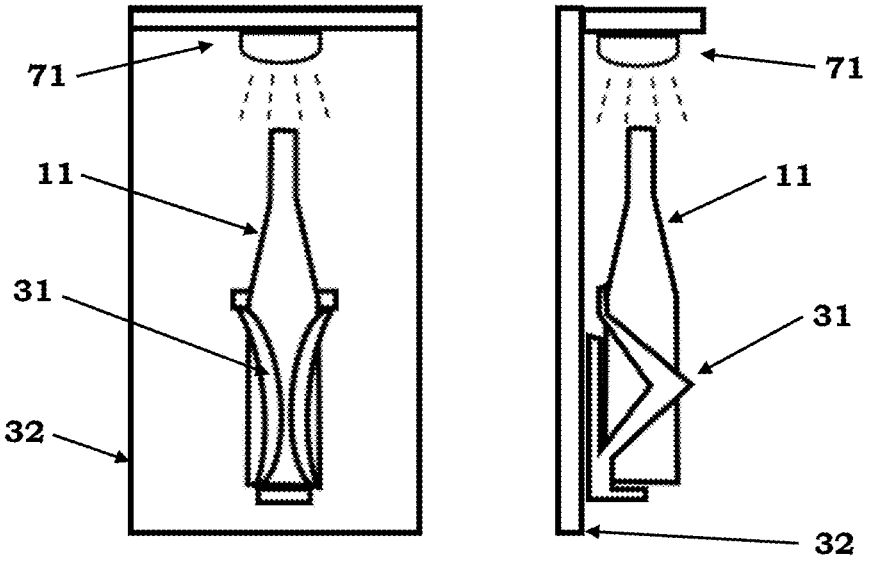
FIG. 7 is an ordinary bottle holder mounted to a planer mount element and having a light mounted from above the bottle such that light is shed on the upper opening of the bottle making it illuminated for play during times of low light and at night.

FIG. 7 is an embodiment comprised of: the commercially available bottle holder 31; that is fixated to the planar mount element 32; and having a light 71 mounted substantially above the bottle 11 such that light is shed on the upper opening of the bottle 11 making it illuminated for play during times of low light and at night.

What is claimed is:

1. A tethered ring game and kit comprised of:

a bottle support cradle having:

a rear support member configured to be fixated above ground level on a vertically erected structure;

a shelf; and arms extending from either the rear support member or the shelf to define an upper opening;

wherein the rear support member, shelf, and arms define a space such that the bottle support cradle is configured to accept a target bottle through the upper opening and constrain a target bottle in a substantially vertical position such that a top portion of a target bottle is configured to extend above the opening defined by the arms; and a ring and tether assembly having:

a ring of sufficient size configured to fit over a top portion of a target bottle; and a tether having first and second ends;

wherein the ring is attached to the first end of the tether and the second end of the tether is configured to be fixated to an overhead support at a position substantially above the bottle support cradle and to be positioned nearly equidistant between a player and the bottle support cradle;

wherein the ring is configured to be swung, tossed, or flipped in a pendulum movement relative to the overhead support in the direction of a target bottle in an endeavor to capture the ring around the top portion of a target bottle.

2. The tethered ring game and kit of claim 1, wherein:

the ring is made of a metallic material and has sufficient weight to keep the tether taut while swinging the ring in a pendulum movement; and the bottle support cradle is:

(a) configured to be mounted directly to a wall, post, or structure; or (b) mounted to a planar mount element which in turn is configured to be mounted to a wall, post, or structure.

3. The tethered ring game and kit of claim 1, wherein:

the ring is made of a metallic material and has sufficient weight to keep the tether taut while swinging it in a pendulum movement.

4. The tethered ring game and kit of claim 1 further comprising:

a light source mounted to the bottle support cradle located at a substantially high elevation to shed light on a target bottle.

* * * * *